US006488322B2

(12) United States Patent
Bakx

(10) Patent No.: US 6,488,322 B2
(45) Date of Patent: Dec. 3, 2002

(54) COLLAPSIBLE ARTICLE CARRIER AND BLANK

(75) Inventor: Martinus C. M. Bakx, Goes (NL)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 10/074,817

(22) Filed: Feb. 13, 2002

(65) Prior Publication Data

US 2002/0113449 A1 Aug. 22, 2002

Related U.S. Application Data

(63) Continuation of application No. PCT/US00/22248, filed on Aug. 11, 2000.

(51) Int. Cl.[7] ..... B65D 71/00

(52) U.S. Cl. ..... 294/87.2; 206/153; 206/158

(58) Field of Search ..... 294/87.2, 87.28, 294/159; 206/145, 147, 148, 150, 151, 153, 158, 162, 170, 175, 192, 199, 427, 429

(56) References Cited

U.S. PATENT DOCUMENTS

| | | | | | |
|---|---|---|---|---|---|
| 2,361,876 | A | | 10/1944 | Schell | 222/107 |
| 3,016,259 | A | * | 1/1962 | Lawrence | 294/87.2 |
| 3,123,213 | A | | 3/1964 | Kulig | 206/158 |
| 3,387,879 | A | * | 6/1968 | Wood | 294/87.2 |
| 3,442,547 | A | * | 5/1969 | Skillen | 294/87.2 |
| 3,526,697 | A | | 9/1970 | Wood | 294/87.2 |
| 3,640,563 | A | | 2/1972 | Wood | 294/87.2 |
| 3,926,307 | A | * | 12/1975 | Klygis | 294/87.2 X |
| 4,305,500 | A | * | 12/1981 | Jaeschke | 294/87.2 X |
| 4,432,579 | A | * | 2/1984 | Denmark et al. | 294/87.2 |
| 5,273,156 | A | * | 12/1993 | Harris | 206/153 X |
| 5,351,815 | A | | 10/1994 | Fogle et al. | 206/153 |
| 5,407,065 | A | | 4/1995 | Sutherland | 206/148 |
| 5,476,170 | A | * | 12/1995 | Weber | 206/153 X |
| 5,687,838 | A | | 11/1997 | Bakx | 206/147 |
| 5,730,353 | A | | 3/1998 | Holley, Jr. | 229/117.05 |

FOREIGN PATENT DOCUMENTS

| | | |
|---|---|---|
| EP | 0 048 506 | 3/1982 |
| EP | 0 662 917 B1 | 7/1995 |
| EP | 0 780 320 A1 | 6/1997 |
| FR | 1 423 952 | 11/1966 |
| FR | 2 391 930 | 12/1978 |
| GB | 902462 | 8/1962 |
| GB | 1 188078 | 4/1970 |
| GB | 2077689 A | 12/1981 |
| GB | 2321229 A | 7/1998 |

* cited by examiner

*Primary Examiner*—Johanny D. Cherry
(74) *Attorney, Agent, or Firm*—Tsugihiko Suzuki

(57) ABSTRACT

An article carrier and blank for forming an article carrier for accommodating a plurality of articles, for example, bottles having a trapezoidal cross section. The carrier comprises a top, a base and opposed sides interconnecting the top and the base wherein one or more of the side walls are placed in an acute angular relationship with respect to the base. The carrier is collapsible along a supplemental hinged connection formed in the base thereby to enable the carrier to move between flat collapsed and set up conditions.

12 Claims, 8 Drawing Sheets

COLLAPSIBLE ARTICLE CARRIER AND BLANK

This is a continuation of international application No. PCT/US00/22248, filed Aug. 11, 2000, which is hereby incorporated by reference.

BACKGROUND OF THE INVENTION

The invention relates to an article carrier produced for packaging a plurality of articles, for example bottles. More particularly the invention relates to a carrier of the top gripping type which attaches to the tops of the articles thereby securing the articles in an array.

It is known to provide top gripping carriers which comprise so called sunburst apertures having a series of circumferencially arranged tabs which enable the bottle top to pass through the apertures which tabs engage on the underside of a bottle top or on the flange of a bottle neck to prevent the removal of the bottle from the aperture. A problem arises when such sunburst type apertures are used for bottles, in particular when the location in which the tab engages the underside of the bottle top is high up on the bottle neck. This creates a carrier that is unstable. Further, the tabs are weakened by the unstable nature of the bottles within the carrier so reducing its effectiveness.

A further problem is that a top gripping carrier needs to be of sufficient strength to support the bottle especially where the bottle is large or if the bottles to be packaged vary in size. One example of a top gripping carrier is illustrated in U.S. Pat. No. 3,528,697 which shows a carrier for gripping an article with a relatively narrow neck, so that the side walls of the carrier are parallel. This carrier is limited to the type of bottles that can be packaged, i.e. narrow necked bottles.

The present invention seeks to overcome or at least mitigate the problems of the prior art.

SUMMARY OF THE INVENTION

One aspect of the invention provides an article carrier for accommodating a plurality of articles, for example, bottles, comprising a top wall, a base and opposed side walls interconnecting the top and the base and one or more of the side walls is arranged in an acute angular relationship with respect to said base to form a tubular structure of trapezoidal cross section. The carrier is collapsible along a supplemental hinged connection formed in the base panel thereby to enable the carrier to move between a flat collapsed and a set up conditions.

Beneficially, the carrier can package a variety of article types with different shapes of neck. Furthermore, the carrier can be transported to the bottler in a collapsed condition to be erected easily during article loading.

According to one optional feature of this aspect of the invention, the hinged connection may be disposed at a location diametrically opposed to one of the four comers of the trapezoid forming the opposing hinged connection when the carrier is placed in a flat collapsed condition.

Optionally, there may further comprise an internal partition panel which is tilted with respect to the top wall to be collapsible.

Preferably, the top wall panel may comprise a plurality of apertures each of which has at least one foldable retention tab to operatively engage the underside of a radially protruding part of a container present in each of the apertures. More preferably, an internal partition may comprise a corresponding plurality of apertures aligned with the top panel apertures. Each of the internal partition apertures has one or more foldable retention tabs which passes through the corresponding top panel aperture to operatively engage another portion of the underside of the radially protruding part.

Each said internal partition aperture may be formed in part by opposite retention tabs of different lengths such that, in use, the upper edges of the internal partition retaining tabs are co-planar with the upper. edge of the at least one retention tab of the top panel.

According to another optional feature of this aspect of the invention, the base may comprise a plurality of lower receiving apertures aligned with the corresponding apertures of the internal partition and the top panel which lower receiving apertures are provided with stabilizing tabs foldably connected to the base panel to support a portion of the article.

A second aspect of the invention provides a blank for forming a tubular article carrier comprising a top wall panel, a side wall panel, a base panel and an opposing side wall panel hingedly connected together in series wherein the distance between the hinged connections of the base panel are greater than the hinged connections of the top panel. The base panel further comprises a supplemental hinged connection to allow the article carrier formed from the blank to be moved between flat collapsed and set up conditions. There may further comprise an internal partition panel hingedly connected to one of the side wall panels which internal partition panel includes securing means to be secured to the opposing one of said side panels.

According to another optional feature of the second aspect of the invention, the top wall panel may have a plurality of apertures each of which has at least one foldable retention tab that can engage part of the article presentation in a set up carrier and wherein said internal partition comprises a corresponding plurality of apertures to be aligned with said top panel apertures when the carrier is in a set up condition, each of which has at least one foldable retention tab which is capable of passing through the corresponding top panel aperture to operatively engage a portion of this article. Optionally, said aperture is divided in part by opposite retention tabs of different lengths such that, in use, the upper edges of the said internal partition retaining tabs are co-planar with the upper edge of said at least one retention tab of said top panel.

The base may comprise a plurality of lower receiving apertures with stabilizing tabs foldably connected to the base panel thereby to support a portion of the article held in a set up carrier.

A third aspect of the invention provides a package comprising a plurality of articles in a grouped arrangement and an article carrier defined m any of the preceding paragraphs.

BRIEF DESCRIPTION OF THE DRAWINGS

Exemplary embodiments of the invention will now be described, by way of example only, by reference to the following drawings, in which.

DETAILED DESCRIPTION OF THE PREFERRED EMBODIMENTS

Figure 1:
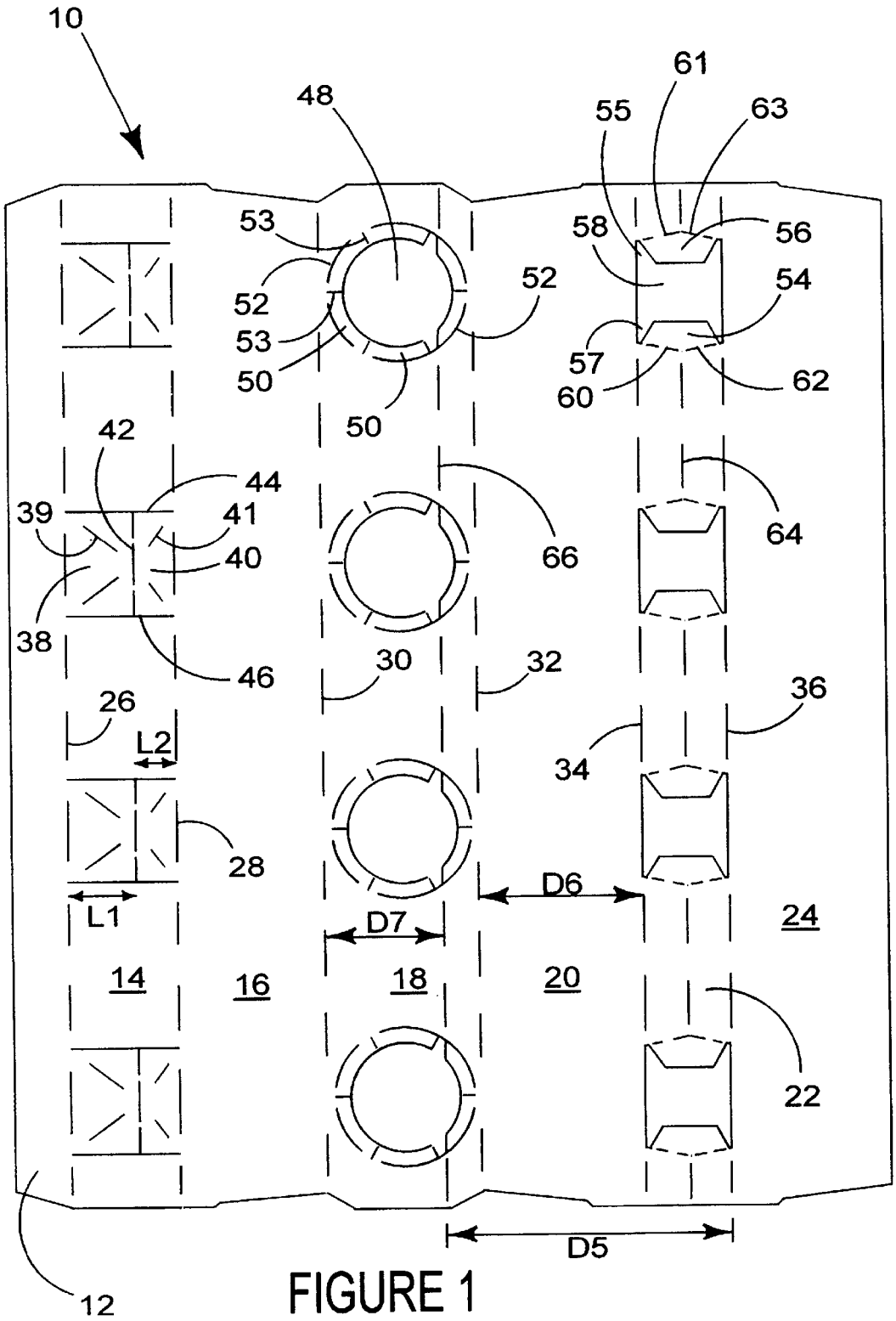
FIG. 1 is a plan view of a blank for forming an article carrier according to one embodiment of the invention.

Referring to the drawings, and in particular FIG. 1 thereof, there is shown a blank 10 for forming an article carrier for accommodating a plurality of articles, for example, bottles, comprising a top wall, a base and opposed side walls interconnecting the top and the base and one or more of said side walls is arranged in an acute angular relationship with respect to said base to form a tubular structure of trapezoidal cross section, wherein the carrier is collapsible along a supplemental hinged connection formed in the base thereby to enable the carrier to move between flat collapsed and set up conditions.

In this embodiment the blank 10 is shaped to form a top gripping article carrier made from paper board or similar foldable sheet material. The blank 10 comprises, an inner first side wall panel 16, base panel 18, a second side wall panel 20, a top wall panel 22 and an outer first side wall panel 24, hingedly connected one to the next along fold lines 30, 32, 34 and 36, respectively. There may further comprise an internal partition structure. The internal partition structure may comprise a partition panel 14 hingedly connected to inner side wall panel 16 along fold line 28.

In those embodiments with an internal partition structure there further comprises a securing means for securing the internal partition panel to one of the side wall panels. Preferably, the securing means is provided by a glue flap 12 hingedly connected to internal partition panel 14 along fold line 26. Alternatively, a locking tab arrangement may be used whereby tabs extending from partition panel 14 are received by corresponding apertures in the adjacent side wall panel.

The base panel 18 includes a fold line 66 extending longitudinally along the length of base panel 18. In use, this fold line 66 enables the carrier to be placed in a fiat collapsed condition described in more detail below.

As illustrated in FIG. 1, the partition panel 14 of this embodiment is formed with one or more pairs 38 and 40 of retention tabs which are foldably connected thereto along fold lines 26 and 28, respectively. In this embodiment, four pairs of retention tabs are provided and are laterally spaced intermediate the side edges of retaining panel 14. Each pair 38 and 40 is struck from retaining panel 14 to define an article receiving aperture 47 illustrated partially in FIG. 5.

Figure 5:
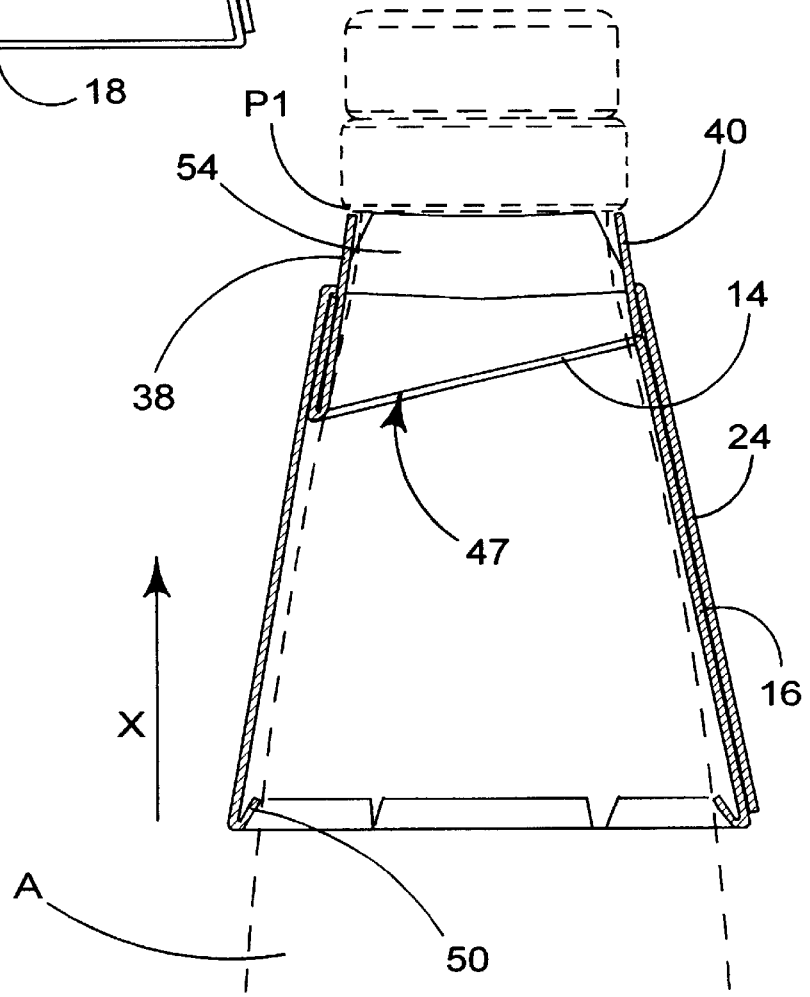
Figure 6B:
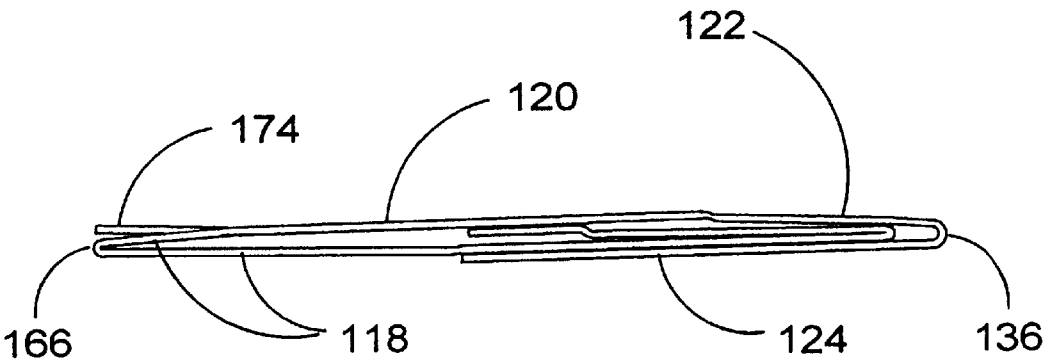
FIG. 6 is an elevational view of the article carrier in set up and collapsed conditions, formed from the blank shown in FIG. 2.
Figure 6A:
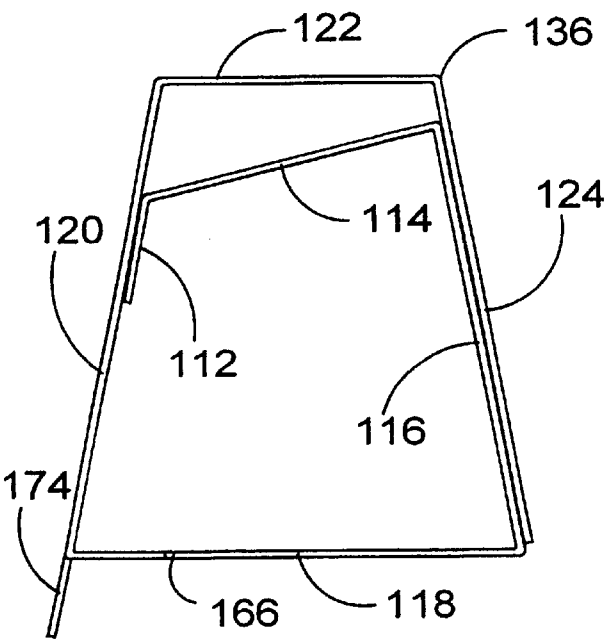
Figure 7:
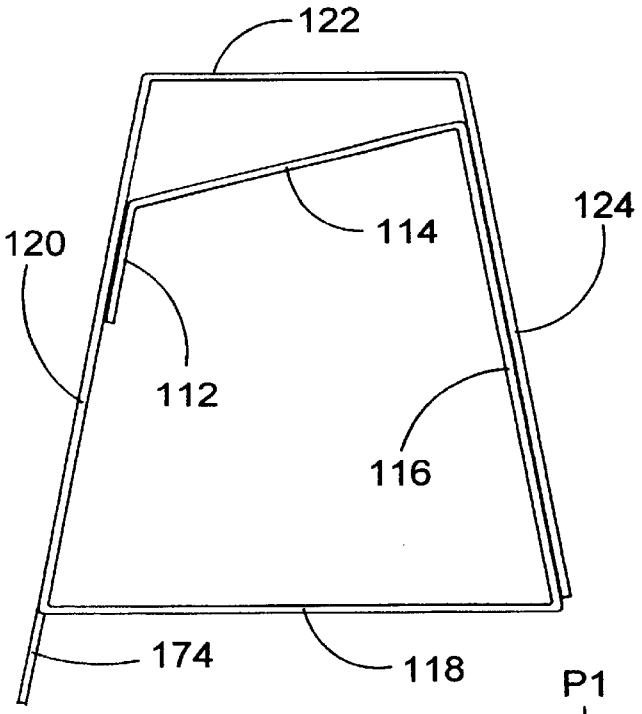
FIGS. 7 and 8 are schematic elevations views of the article carrier formed from the blank shown in FIG. 2.
Figure 8:
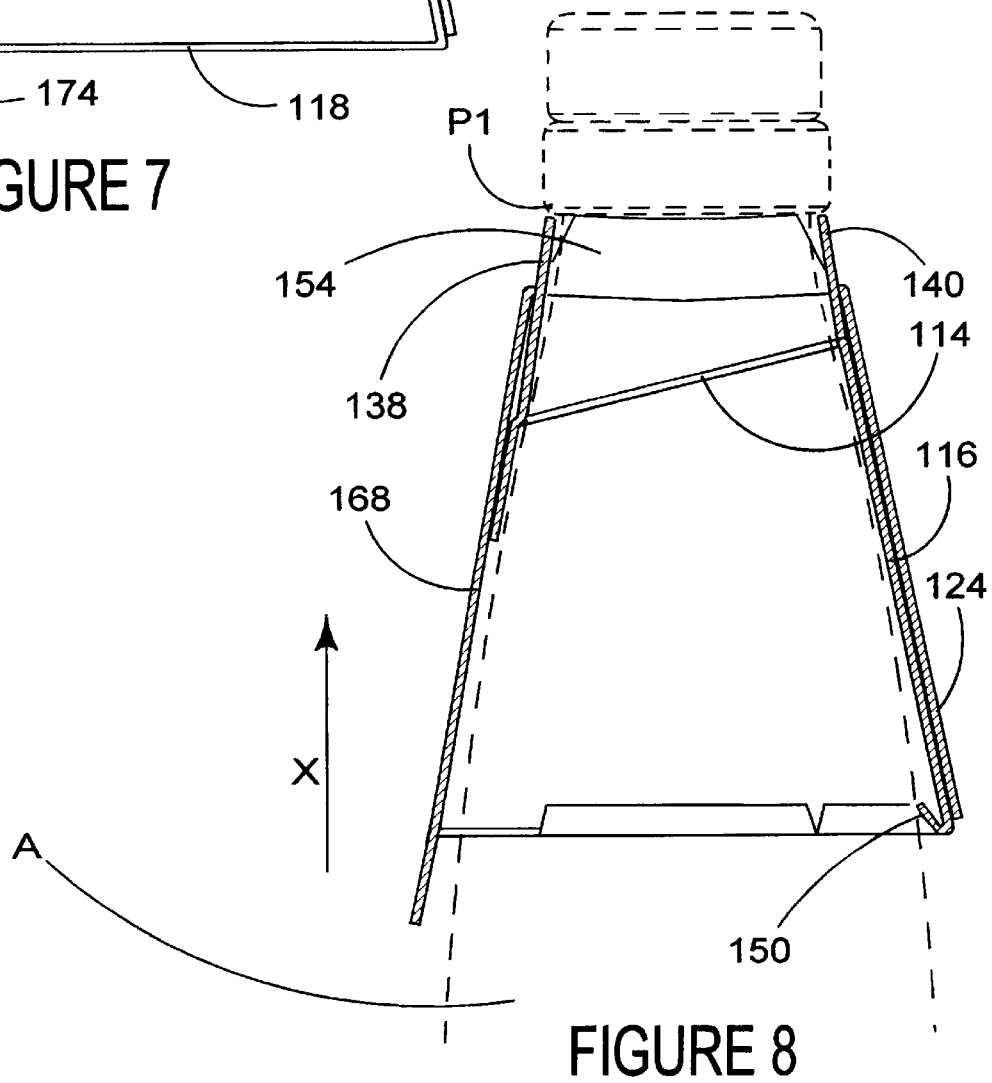

Turning in detail to the preferred configuration of one pair 38, 40 of retention tabs, there comprises retention tab 38 struck from and hingedly connected to glue flap 12 along fold line 26. Tab 38 extends inwardly of retaining panel 14 to its distal edge. A second retention tab 40 is hingedly connected to side panel 16 along fold line 28 and in this embodiment, tab 40 is oppositely disposed to tab 38 and extends into aperture 47 (FIG. 5). The distal edge of tab 40 is juxtaposed the distal edge of tab 38 and is separated therefrom by cut line 42. Tabs 38 and 40 comprise opposed side edges formed from cut lines 44, 46. Each tab 38, 40 may further comprise one or more stress relief fold lines 39, 41 to assist in deforming the retaining tabs without tearing occurring. It will be seen from FIG. 1 that stress relief lines diverge outwardly from the distal edges of the retaining tab 38, 40 towards the proximal comers of the respective tabs. The length L1 of retaining tab 38 is longer than the length L2 of tabs 40, for the reasons outlined below.

The base panel 18 includes a plurality of lower article receiving apertures 48 which, in this embodiment, comprises four apertures in spaced collinear arrangement adapted to receive an upper portion of the article, for example, the neck of a bottle. The apertures 48 are positioned to be aligned with the corresponding aperture 47 in the internal partition. Preferably, each aperture 48 is provided with a plurality of tabs 50 arranged concentrically around the edge of the aperture. Each tab 50 is foldably connected to base panel 18 along fold line 52 and is separated from the next adjacent tab by cut line 53. Of course, in some embodiments, the tabs 50 are spaced apart. The tabs 50 are provided to allow articles of different sizes to be loaded into the article carrier whereby an article with a larger diameter of neck causes the tabs 50 to be moved out of alignment with respect to the base panel 18.

The top panel 22 may also comprise a plurality of apertures 58 that are aligned with the corresponding aperture 48 in the base panel 18. It will be seen from FIG. 1 that there may further comprise one or more tabs extending inwardly into the aperture 50. In this embodiment there comprises a pair of tabs 54, 56 hinged to opposing side edges of the aperture 58. The hinged connection for each tab 54, 56 is provided by one or more fold lines. FIG. 1 illustrates divergent fold lines 60, 62 and 61, 63, respectively, to connect to the side edges of the respective aperture 58. Aperture 58 is shaped to receive the corresponding retaining tabs 38, 40 from the internal partition panel 14, discussed in more detail below.

In this embodiment, the top panel 22 also comprises fold line 64 that extends longitudinally along a central portion of the top panel 22 and is interrupted by apertures 58. In use, fold line 64 assists in causing the retaining tabs to move out of alignment with the top panel 22.

It is envisaged that suitable handle means generally known may be provided in the top and/or side panels.

Figure 2:
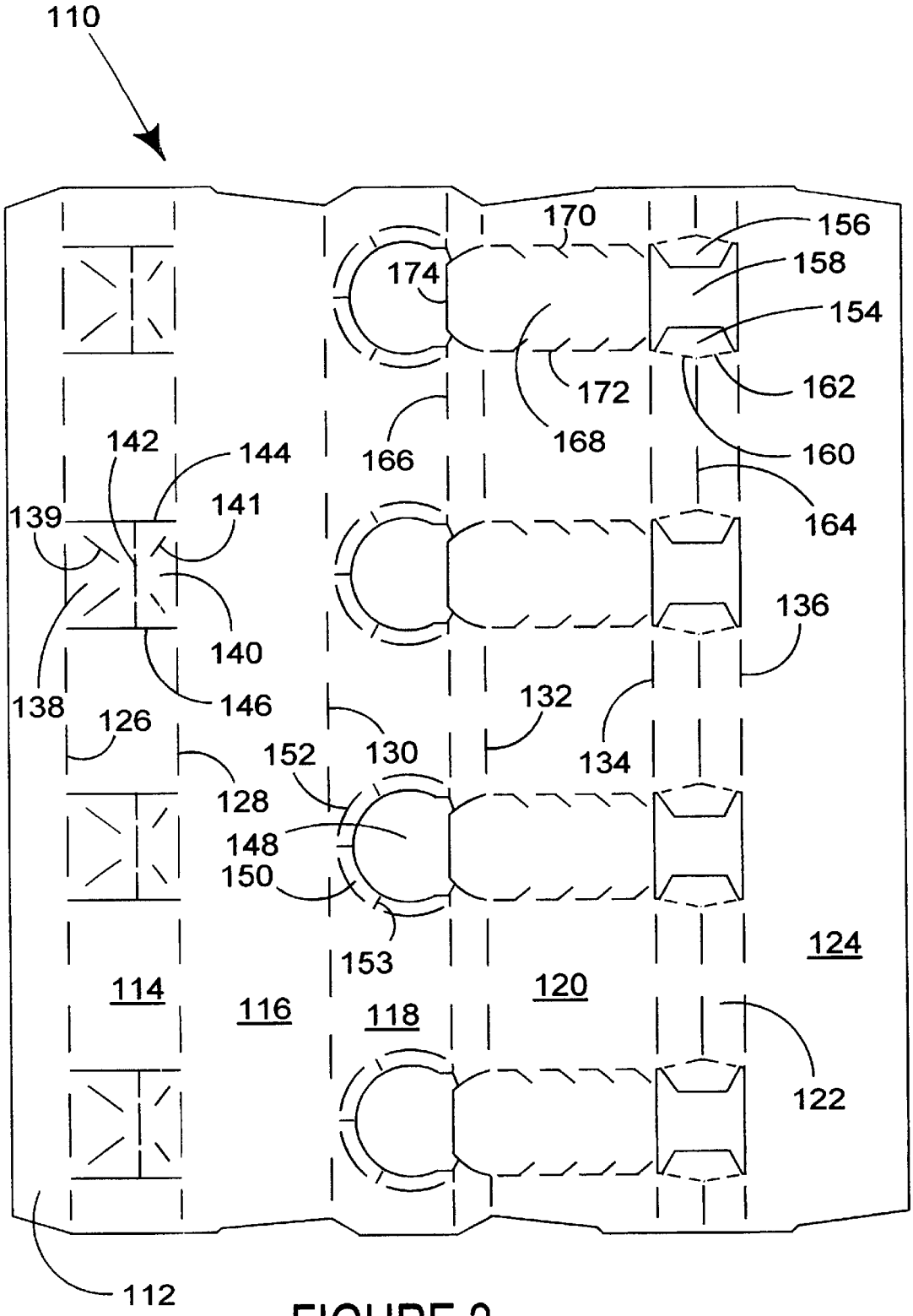
FIG. 2 is a plan view of a blank for forming an article carrier according to another embodiment of the invention.

FIG. 2 illustrates a second embodiment of the invention which is similar to the first embodiment and therefore corresponding panels are numbered with the same reference numerals but prefixed with the reference numeral "1". As the blank of the second embodiment is similar to the first embodiment, only those differences shall be described in any further detail. The second embodiment further comprises a tear strip 168 struck from second side panel 120 and extending between apertures 148 and 158. The strip 168 is frangibly connected to side panel 120 along tear lines 170 and 172. There may further comprise a tab 174 which extends downwardly below the base panel in set up condition to assist in pulling the tear strip from the carrier thereby to provide access to the article so that it can be removed without destroying the integrity of the carrier.

Turning to the construction of the carrier, by reference to FIGS. 3, 4, 5 and 9, the blank 10 requires a series of sequential folding and gluing operations to form the carrier which can be performed in a straight line machine so that the carrier is not required to be rotated or inverted to complete its construction. The folding process is not limited to that described below and can be altered according to particular manufacturing requirements.

Figure 3B:
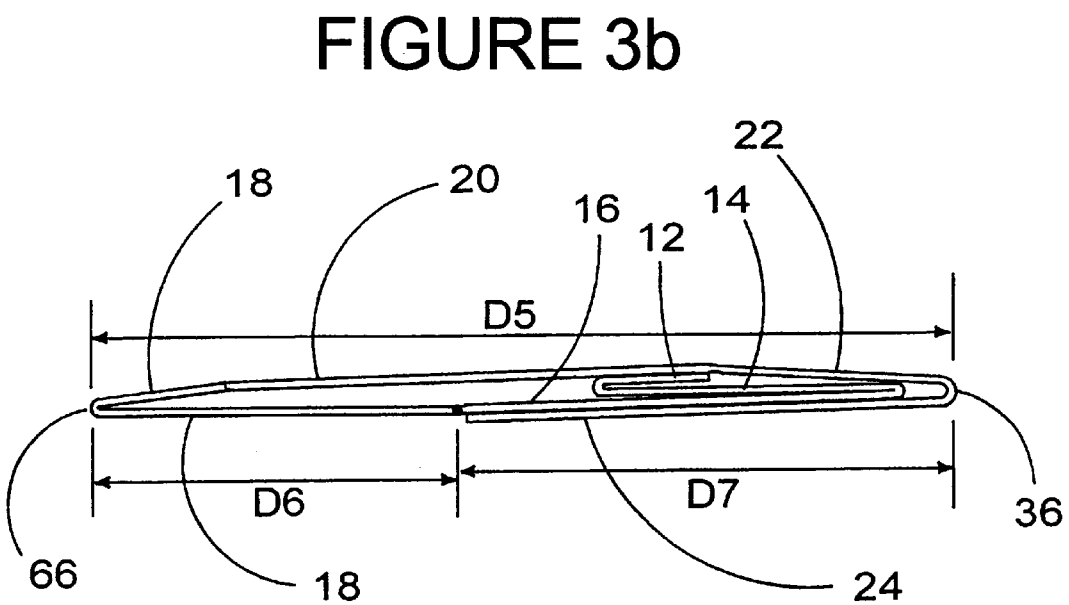
FIG. 3 is an elevational view of the article carrier in set up and collapsed conditions, formed from the blank shown in FIG. 1.
Figure 3A:
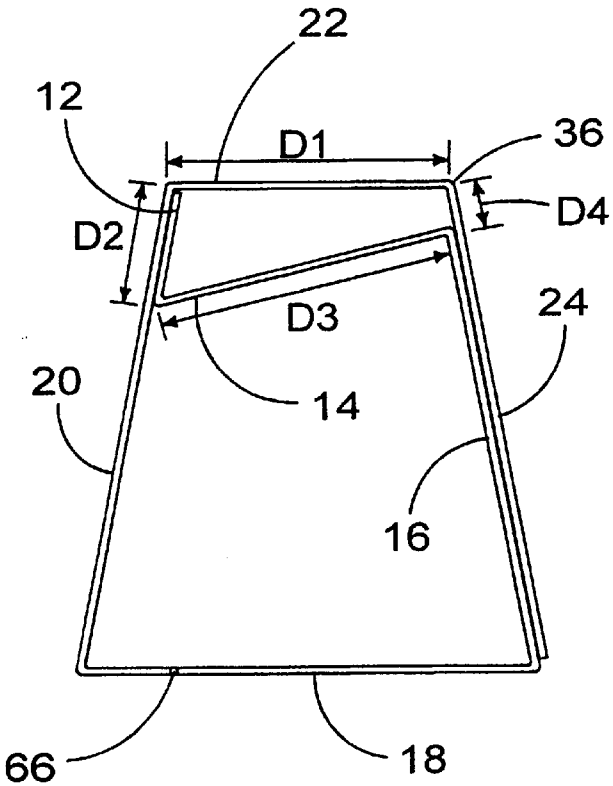

The first stage of construction is for the carrier to be formed into a flat collapsed condition. This is achieved by folding partition panel 14 and glue flap 12 about fold line 28 to bring the aforesaid panels into face contacting relationship with first inner side wall panel 16 and part of base panel 18, respectively. Thereafter, the blank is folded about fold line 66 whereby panels 12, 14, 16 and 18, are folded so as to bring glue flap 12 into face contacting relationship with second side wall panel 20 such that they may be may secured together by glue or other suitable means known in the art. Outer first side wall panel 24 is folded along fold line 36 into overlapping relationship with inner side wall panel 16 and is they are secured together by glue or other suitable means known in the art. Thus, the carrier is in flat collapsed condition as illustrated in FIG. 3. It will be seen that the hinged connection formed by fold line 66 is diametrically opposed to the hinged comer 36 formed by top panel 22 and side wall 16/24 such that dimension D5 is substantially equal to the total of dimensions D6 and D7 (FIG. 1) to enable the carrier to collapse.

In those embodiments with an internal partition, the partition panel 14 tilts with respect to the top panel 22 so that it can collapse without its integrity being damaged by unwanted folding. To achieve this, the panel is tilted so that the distance D1 of top panel 22 and the distance D2 of the side wall 20 is equal to the total of the distance D3 of the partition panel 14 and the distance D4 of side wall 24, shown in FIG. 3.

The carrier is supplied to a bottler for final erection and loading. In the first stage of the loading process, the carrier is erected by compressing the edges formed by the hinged connections 66 and 36. Thereafter, the bottles A are grouped together in a row of articles, for example 1×4, and the erected carrier is introduced to the group from above by relative vertical means between the bottles and the blank preferably during forward feed movement as is well known in the art.

Figure 4:
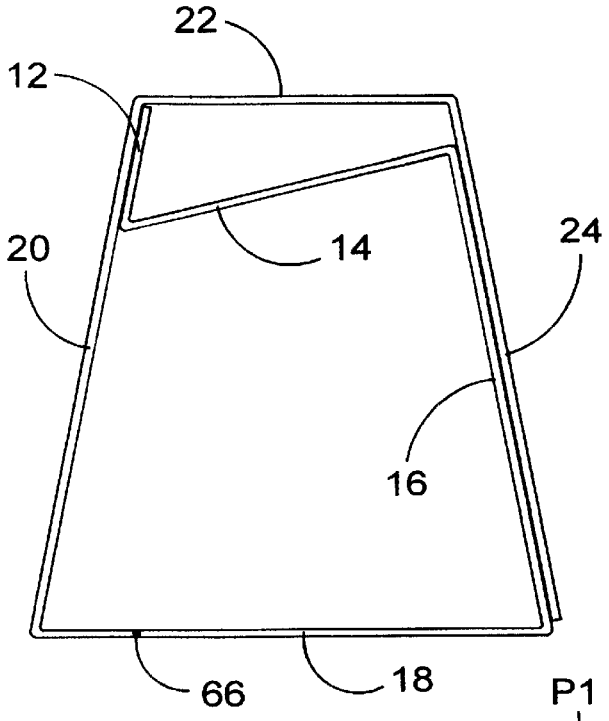
FIGS. 4 and 5 are schematic elevational views of the article carrier formed from the blank shown in FIG. 1 shown during loading.

As the carrier is lowered, it is erected whereby the side wall panels 16/24, 20 are moved apart and the base 18 is folded out of alignment with respective side wall panels. Those portions of base panel 18 on either side of fold line 66 are placed in a collinear relationship, as shown in FIG. 4. Similarly, the top panel 22 is folded along fold lines 34 and 36 into a spaced arrangement with the base panel 18 and the carrier is thus erected as shown in FIG. 4.

The articles are then inserted into apertures 48 in the base panel 18 and for the larger articles, tabs 50 are moved out of alignment with base panel 18. As the articles move in direction X, the retaining tabs 38, 40 in the partition panel 14 are folded out of alignment about fold lines 26 and 28, respectively, to reveal aperture 47 and are pushed upwardly through aperture 58 together with the upper portion of the article. As shown in FIG. 5, the article continues to move through aperture 58 and tabs 54 and 56 are folded out of alignment with top panel 22 such that retention tabs 54, 56 and 38, 40 are folded upwardly to come into contact with and engage with the underside of a protruding portion P1 of the bottle associated within each of the apertures 48 and 58. To assist this, the tabs 38, 40 are different lengths L1, L2 respectively, so that the tilted arrangement does not affect the relative positions of the upper edges of the tabs.

In the embodiment illustrated, the tabs 54, 56 are shaped to include recesses 55,57 (FIG. 1) on each side so as to allow tabs 38, 40 to be engaged in the recesses, thereby to minimize movement of these tabs, once erected.

Figure 9:
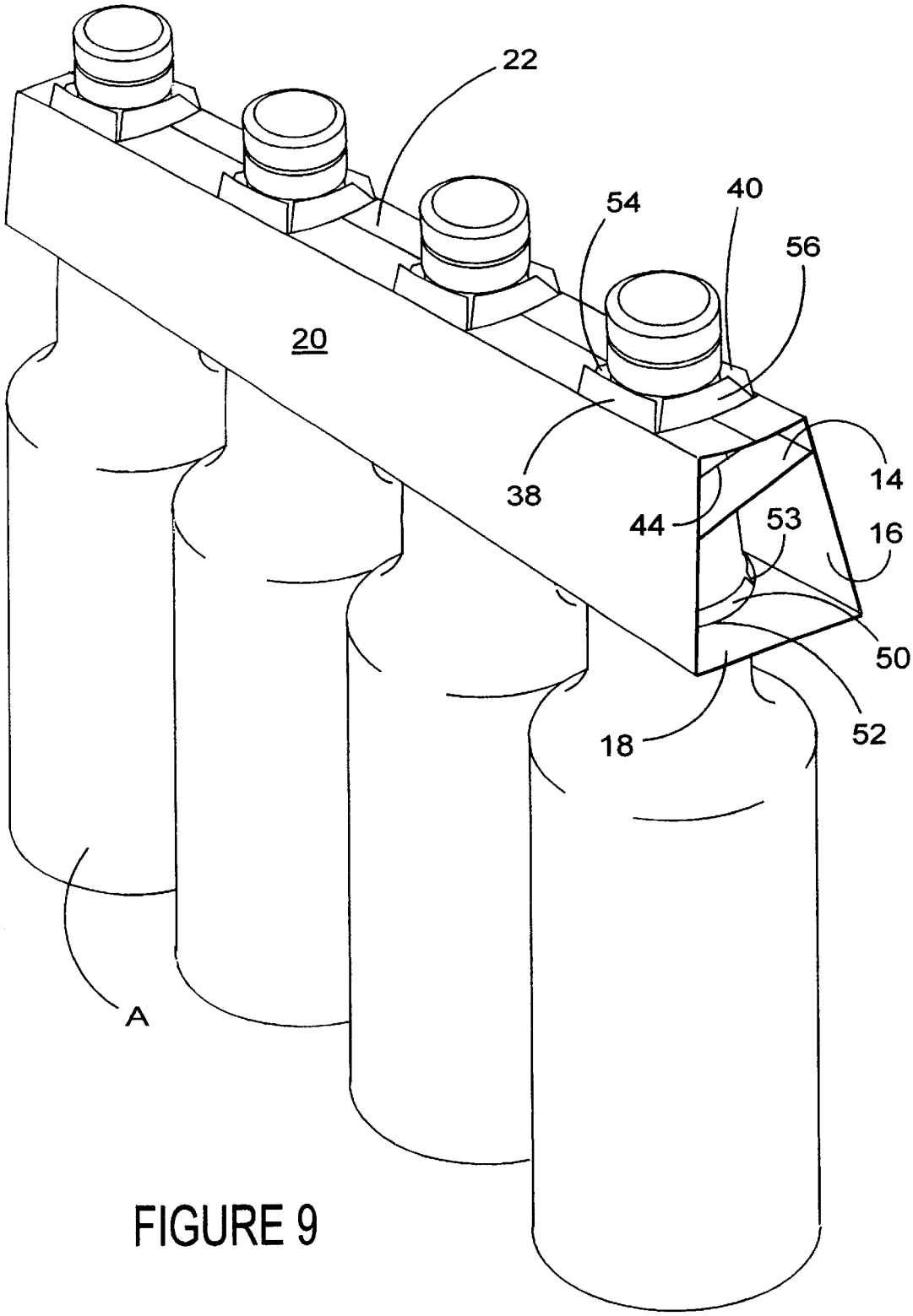
FIG. 9 is a perspective view of the article carrier set up and loaded and formed from the blank of FIG. 1.

Optionally, the edge of each article receiving aperture 48, 58 is in contact with a neck portion of each of the respective bottles B to provide additional support. Thus, the distal edges of tabs 38, 40 and 54, 56 are engaged with the underside of the protruding portion P1. Beneficially, partition panel 14 serves as a brace between the opposing side panels as shown in FIG. 5. In use, the partition panel 14 provides a support to better maintain the bottles in an upright position. Thus, the carrier is provided in a fully loaded and erected condition as shown in FIG. 9.

Figure 10:
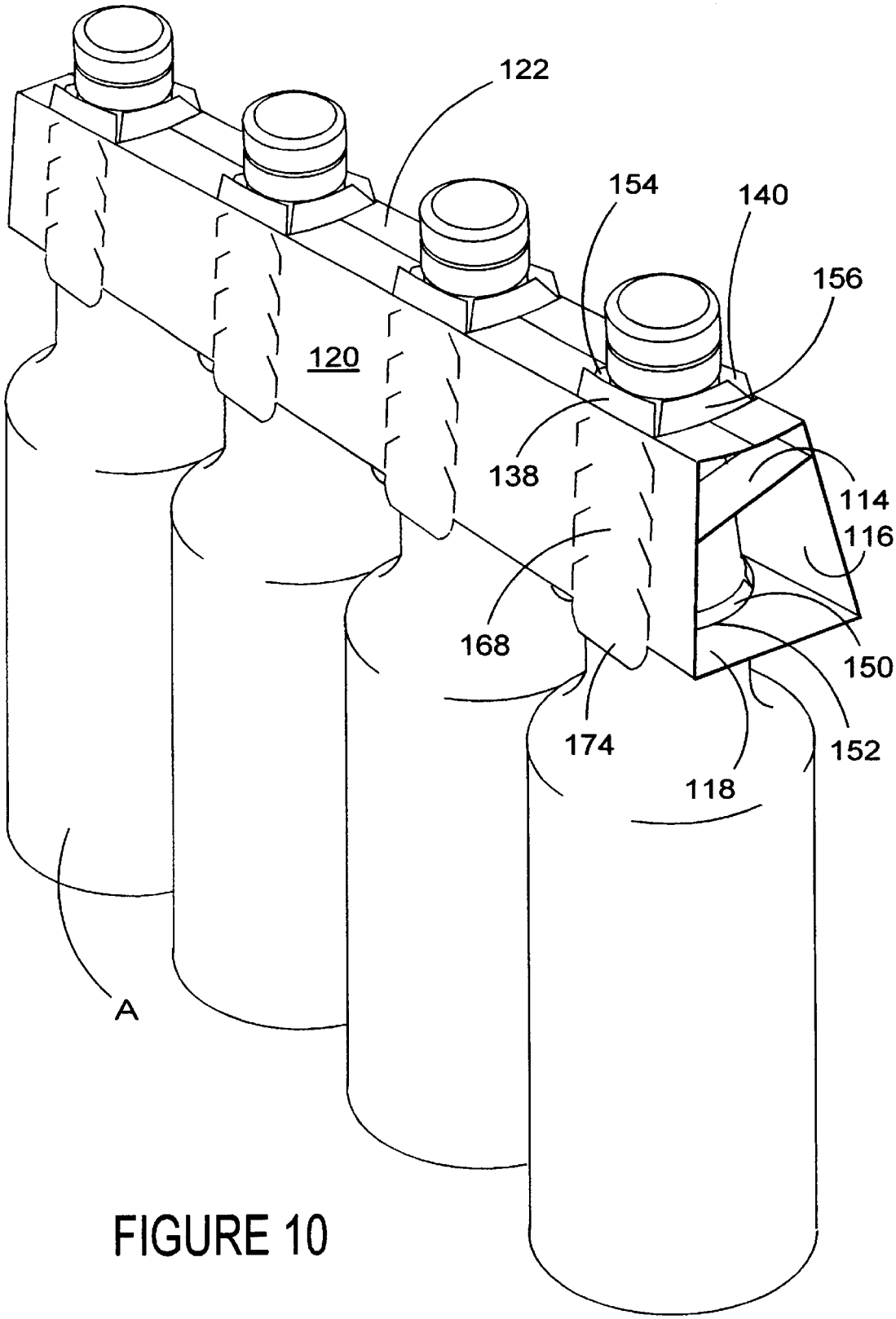
FIG. 10 is a perspective view of the article carrier set up and loaded and formed from the blank of FIG. 2.

The construction of the second blank to form the carrier shown in FIG. 10 is substantially the same as the first blank, which is illustrated in FIGS. 6, 7, 8 and 10, and is not, therefore described in any more detail. However, the pull tab 174 is clearly illustrated.

It will be recognized that as used herein, directional references such as "top", "base", "end", "side", "inner", "outer", "upper" and "lower" do not limit the respective panels to such orientation, but merely serve to distinguish these panels from one another. Any reference to hinged connection should not be construed as necessarily referring to a single fold line only: indeed, it is envisaged that hinged connection can be formed from one or more of one of the following, a score line, a frangible line or a fold line, without departing from the scope of invention.

The present invention and its preferred embodiments relate to an article carrier which is shaped to provide satisfactory strength to hold bottles securely but with a degree of flexibility so that the load transferred through the retention tabs is absorbed by the carrier. The shape of the blank minimizes the amount of paper that would be required and the carrier can be applied to an array of bottles by hand or automatic machinery. It is anticipated that the invention can be applied to a variety of carriers and is not limited to those of the top-gripping type. In particular, it is possible to use the invention for wraparound or end loaded carriers, in which case the base would not have apertures and the internal partition may be dispensed with. Importantly, the hinged connection in the base panel would be provided to ensure the carrier could be placed in a flat collapsed condition.

Furthermore, it is envisaged that the invention can be applied to a carrier with a different arrangement of articles, for example two rows of three articles without departing from the scope.

What is claimed is:

1. An article carrier for accommodating at least one article, comprising a top, a base, opposed side walls hingedly interconnecting the top and the base, and an internal partition panel extending between said side walls, wherein one or both of said side walls are arranged in an acute angular relationship with respect to said base to form a tubular structure of a trapezoidal cross section, wherein the carrier is collapsible along a supplemental hinged connection formed in said base thereby to enable the carrier to move between a flat collapsed condition and a set up condition, wherein said internal partition panel is hingedly connected to one of said side walls along a first fold line and to the other side wall along a second fold line, and wherein said first fold line is disposed at a greater distance from said top than said second fold line to allow the carrier to move between said collapsed and set up conditions.

2. The article carrier as claimed in claim 1 wherein said supplemental hinged connection is disposed at a location closer to said one side wall than to said other side wall, said supplemental hinged connection being disposed diametrically opposed to one of the four comers of said trapezoidal tubular structure, said one corner forming an opposing hinged connection opposite to said supplemental hinged connection when the carrier is in said flat collapsed condition.

3. The article carrier as claimed in claim 1 wherein a glue flap is hingedly connected to said internal partition panel along one of said first and second fold lines and secured to an associated one of said side walls, said glue flap extending between said one fold line and said top to facilitate positioning of said one fold line with respect to said top.

4. The article carrier as claimed in claim 1 wherein the total of the width of said top and said greater distance is generally equal to the total of the width of said internal partition panel and the distance between said second fold line and said top.

5. The article carrier as claimed in claim 1 wherein the top comprises at least one upper aperture, wherein said one upper aperture has at least one foldable retention tab to operatively engage an underside of a radially protruding part of an article present in said one upper aperture, and wherein said internal partition panel comprises at least one medial aperture aligned with said one upper aperture, said one medial aperture has one or more foldable retention tabs which passes through said one upper aperture to operatively engage another portion of said underside of said radially protruding part.

6. The article carrier as claimed in claim 5 wherein said one medial aperture is formed in part by a pair of opposite retention tabs of different lengths such that, in use, upper edges of said opposite retention tabs are co-planar with an upper edge of said one foldable retention tab of said top.

7. The article carrier as claimed in claim 1 wherein said base comprises at least one lower aperture aligned with at least one aperture formed in said internal partition panel, and said one lower aperture is provided with stabilizing tabs hingedly connected to the base to support a portion of an article present in said one lower aperture.

8. A blank for forming a tubular article carrier comprising a top panel, a first side wall panel, a base panel and an opposing second side wall panel hingedly connected together in series, wherein the distance between the hinged connections of the base panel is greater than the hinged connections of the top panel, wherein the base panel comprises a supplemental hinged connection to allow the article carrier formed from the blank to be moved between flat collapsed and set up conditions, and wherein the blank further comprises an internal partition panel hingedly connected to said second side wall panel, said internal partition panel including securing means to be secured to said first side wall panel.

9. The blank claimed in claim 8 wherein the top panel has at least one upper aperture having at least one foldable retention tab that can engage part of an article present in a set up carrier, and wherein said internal partition panel comprises at least one medial aperture to be aligned with said one upper aperture when the carrier is in a set up condition, said one medial aperture having at least one foldable retention tab which is capable of passing through said one upper aperture to operatively engage a portion of said article.

10. The blank as claimed in claim 9 wherein said one foldable retention tab of said internal partition panel comprises a pair of opposite retention tabs of different lengths such that, in use, upper edges of said opposite retention tabs are co-planar with an upper edge of said one retention tab of said top panel.

11. The blank as claimed in claim 8 wherein said base panel comprises at least one lower receiving aperture with stabilizing tabs hingedly connected to the base panel thereby to support a portion of an article held in a set up carrier.

12. The blank as claimed in claim 8 wherein said internal partition panel is of a greater width than said top panel so that said internal partition panel is inclined to said top panel when said blank is erected into a tubular carrier.

* * * * *